US010160232B1

(12) United States Patent
Griffin et al.

(10) Patent No.: US 10,160,232 B1
(45) Date of Patent: Dec. 25, 2018

(54) INK-JET PRINTING SYSTEMS

(71) Applicant: XEROX CORPORATION, Norwalk, CT (US)

(72) Inventors: Scott J Griffin, Fairport, NY (US); David M Skinner, Rochester, NY (US); Eric Robert Dudek, Webster, NY (US); Kyle B Tallman, Perry, NY (US); Michael S Roetker, Webster, NY (US); Jin Wu, Rochester, NY (US); James E Williams, Penfield, NY (US); Jason M LeFevre, Penfield, NY (US); Paul S Bonino, Ontario, NY (US); Carlos M Terrero, Ontario, NY (US)

(73) Assignee: XEROX CORPORATION, Norwalk, CT (US)

( * ) Notice: Subject to any disclaimer, the term of this patent is extended or adjusted under 35 U.S.C. 154(b) by 5 days.

(21) Appl. No.: 15/617,047

(22) Filed: Jun. 8, 2017

(51) Int. Cl.
*B41J 11/00* (2006.01)

(52) U.S. Cl.
CPC ..... *B41J 11/0015* (2013.01); *B41J 11/0085* (2013.01)

(58) Field of Classification Search
CPC ..... B41J 11/0015; B41J 11/0085
See application file for complete search history.

(56) References Cited

U.S. PATENT DOCUMENTS 4,379,301 A 4/1983 Fischbeck
4,386,358 A 5/1983 Fischbeck
4,734,705 A 3/1988 Rezanka et al.
5,997,974 A 12/1999 Schlueter, Jr. et al.
6,079,814 A 6/2000 Lean et al.
6,106,762 A 8/2000 Agur et al.
6,594,460 B1 7/2003 Williams et al.
7,204,584 B2 4/2007 Lean et al.
8,142,010 B2 3/2012 Ageishi
8,293,338 B2 10/2012 Castelli et al.
8,408,539 B2 4/2013 Moore
8,840,241 B2 * 9/2014 Fletcher ..... B41J 11/0085 347/104
8,947,482 B2 2/2015 Ramesh et al.
8,998,403 B2 * 4/2015 Fletcher ..... B41J 11/007 347/101
9,114,609 B1 8/2015 Folkins et al.
9,132,673 B2 9/2015 Fletcher et al.
9,211,736 B2 * 12/2015 Fletcher ..... B41J 11/06
9,327,526 B2 * 5/2016 Fletcher ..... B41J 13/0009

* cited by examiner

*Primary Examiner* — Huan H Tran
(74) *Attorney, Agent, or Firm* — MH2 Technology Law Group LLP

(57) ABSTRACT

A media transport system for conveying sheets of media along a process path extending from a media-uptake zone and thereafter through a print zone. The system includes a transport belt for holding the sheets of media generally flat via vacuum for ink jet printing. The media transport system includes a seamed vacuum transport belt, and a platen supporting the belt. The belt comprises a partially-conductive coating having a surface resistivity of from about $10^1$ to about $10^6$ ohms per square on a polymeric substrate. The partially-conductive coating comprises a polyester and a conductive component such as carbon black, and optionally includes a plasticizer and a leveling agent. The polymeric substrate is either a thermoplastic or a thermoset material.

11 Claims, 5 Drawing Sheets

INK-JET PRINTING SYSTEMS

TECHNICAL FIELD

While embodiments disclosed herein generally relate to certain conventional media-marking systems, the embodiments disclosed and described herein relate, in particular, to ink-jet printing systems.

BACKGROUND

Conventional ink-jet printing systems use various methods to cause ink droplets to be directed toward recording media. Well known ink-jet printing devices include thermal, piezoelectric, and acoustic ink jet print head technologies. All of these ink-jet technologies produce roughly spherical ink droplets having a 15-100 μm diameter directed toward recording media at approximately 4 meters per second. Located within these print heads are ejecting transducers or actuators, which produce the ink droplets. These transducers are typically controlled by a printer controller, or conventional minicomputer, such as a microprocessor.

A typical printer controller will activate a plurality of transducers or actuators in relation to movement of recording media relative to an associated plurality of print heads. By controlling activation of transducers or actuators and recording media movement, a printer controller should theoretically cause produced ink droplets to impact recording media in a predetermined way, for the purpose of forming a desired or preselected image on the recording media. An ideal droplet-on-demand type print head will produce ink droplets precisely directed toward recording media, generally in a direction perpendicular thereto. However, in practice, a number of ink droplets, for various reasons, are not directed exactly perpendicularly to the recording media; and, ink droplets that deviate from a desired trajectory, and which result in misdirected droplets impacting recording media at locations not anticipated by a controller of a printer, are problematic. As a result, the misdirected droplets generally negatively affect the quality of a printed image—typically by impacting the recording media in undesired locations.

To correct misdirected ink jet trajectories, for instance, U.S. Pat. Nos. 4,386,358 and 4,379,301 disclose methods for electrostatically deflecting electrically charged ink droplets ejected from ink jet print heads. Briefly summarizing methods disclosed in these patents, charges placed on electrodes on the print heads are "controlled," to steer charged ink droplets in desired directions to compensate for known print head movement. By electrostatically steering the charged ink droplets thusly, the methods disclosed in these patents compensate for ink droplet misdirection caused by the known print head movement, when an ink droplet is ejected. However, the electrostatic deflection method disclosed in these patents does not compensate for unanticipated or unpredictable factors, which can affect ink droplet trajectories.

To solve the problem (noted in the preceding paragraph) U.S. Pat. No. 6,079,814 discloses a droplet-on-demand ink jet printer that makes use of an electrostatic phenomenon known as "tacking," which is simply the attachment, resulting from electrostatic attraction, of one item or article to another. In the application of this well-known electrostatic principle, U.S. Pat. No. 6,079,814 discloses tacking recording media, e.g., paper, in order to achieve precise attachment of an aligned piece of recording media onto a dielectric surface of a transport belt, for achieving assurance of precise motion of the recording media relative to the print heads, for precise ink droplet placement on the recording media. To summarize, a transport belt is electrostatically charged with a charge of one polarity, so that the resulting electrostatic charge precisely holds the recording media in a precisely aligned position on the transport belt after the media is fed thereon and concurrently induces a charge of opposite polarity on the ink droplets ejected by the print head, for accelerating the ink droplets toward the recording media.

As a refinement, or perhaps reversal, of the tacking phenomena discussed above in U.S. Pat. No. 6,079,814, U.S. Pat. No. 8,293,338 describes and discloses a process whereby print media sheets are moved downwardly past a so-called "de-tacking unit," designed to reverse the electrostatic charge on the print media, in order to allow transfer of the print media from a first endless belt to a second endless belt. U.S. Pat. No. 8,293,338 describes and discloses the second belt as passing over a porous stationary platen. U.S. Pat. No. 8,293,338 further states that the platen is connected through a conduit to a vacuum pump which, via the platen porosity and first belt, causes the sheet stock to adhere to the platen and remain vertically positioned thereon.

As perhaps still another refinement of the tacking phenomena described above (in relation to U.S. Pat. No. 6,079,814), U.S. Pat. No. 8,408,539—which is directed to a sheet hold down and transport apparatus—discloses and describes inboard and outboard tacking rollers that are in operative communication with a high-voltage power source, wherein the tacking rollers deposit a static charge on an upper surface of certain edges of a media sheet. U.S. Pat. No. 8,408,539 further discloses that a transport belt is preferably formed of a nonconductive material; and that the charged surface of the sheet edges are attracted to the belt. U.S. Pat. No. 8,408,539 further discloses that the tacking rollers are biased to a potential sufficiently high to generate air breakdown adjacent to a nip formed by the tacking rollers and the belt, and that as a sheet enters the nip, the air breakdown will deposit net charge onto the top of the sheet along its inboard and outboard edges, thereby holding the sheet edges flat to the belt. This patent further discloses that medial portions of the belt, between the tacking rollers constitutes an image zone which aligns with a print head, that the portion of the sheet of media lying in the image zone will receive the image, and that positioning the tacking rollers on the sheet edges and outside the image zone, the image zone remains substantially free of electrostatic charges.

Still another solution to the problems caused by misdirected ink jet droplets impacting recording media is described in U.S. Pat. No. 7,204,584 which discloses and describes a transfer belt apparatus, a system and various methods, all of which are directed to preventing image blooming, where the term "image blooming" is understood to mean that a printed image is wider, occasionally much wider, than desired and may have indistinct edge margins, all of which are problematic. Accordingly, to prevent image blooming, U.S. Pat. No. 7,204,584 discloses that an ink jet printing apparatus may include a grounded print head, a counter-electrode opposite the grounded print head, and a bi-layer transfer belt located between print heads and the counter-electrode and at least partly supported by at least two transfer bias rollers. U.S. Pat. No. 7,204,584 also discloses and describes a particular method of operation that may include applying a predetermined voltage between a print head and a counter-electrode to accelerate ink drops ejected from a print head toward a transfer belt, for removing charge on the belt.

To further refine the "image blooming" problem, described above, U.S. Pat. No. 8,142,010 discloses and describes a transporting belt for inkjet use, where the belt is characterized by a seamless belt shape having at least one layer comprising at least one of a polyamide resin, a polyester resin, and a polyimide resin, as the resin component and a conductive filler, and having a volume resistivity of about $10^{10}$ to $10^{14}$ ohm-centimeters (Ω·cm).

As yet another solution to the problems caused by misdirected ink jet droplets impacting recording media, certain embodiments of a system to reduce electrostatic fields underneath print heads in a direct marking printing system are disclosed and described in U.S. Pat. No. 8,947,482. One such system that is disclosed in U.S. Pat. No. 8,947,482 includes one or more print heads for depositing ink onto a media substrate; a media transport for moving the media substrate along a media path past the one or more print heads; a conductive platen contacting the media transport belt; an electrostatic field reducer that includes an alternating current charge device positioned upstream of the one or more print heads; and one or more electrically biased electrodes in registration with the ink deposition areas of the one or more print heads. U.S. Pat. No. 8,947,482 states that the media transport includes a media transport belt which, when media is on the transport belt, can generate an electrostatic field, to cause printing defects. U.S. Pat. No. 8,947,482 states that the electrostatic field reducer along with the electrodes reduce the electrostatic field on the surface of the media and thereby reduce printing defects.

Still another solution to problems caused by misdirected ink jet droplets impacting recording media are disclosed and described in U.S. Pat. No. 9,114,609—which is directed to an inkjet printer system that includes an electrode located either in a print head or in an image receiving member, where the image receiving member is operatively connected to a waveform generator. During operation of the system, a controller operates the waveform generator to generate an electrostatic field between the print head and the image receiving member during normal operation of inkjets in the print head to eject ink drops. In particular, the controller operates the waveform generator to reduce an amplitude of the electrostatic field while the ink drops travel toward the image receiving member during a time when satellite ink drops can be formed from ejected ink drops. The controller also subsequently operates the waveform generator to generate the electrostatic field while the ink drops are in flight after formation of the satellites, to accelerate the ink drops and satellites towards the image receiving member.

As yet another solution to problems caused by misdirected ink jet droplets impacting recording media, U.S. Pat. No. 9,132,673 discloses a semi-conductive media transport system used in conjunction with an ink jet printing system. Since the purpose of "an invention" is often to solve "a problem," a problem the U.S. Pat. No. 9,132,673 inventors focused their efforts on may be stated thusly: In order to ensure good print quality in direct-to-paper (DTP) ink-jet printing systems, the media must be held extremely flat in the print zone. The belt itself must be held flat against a platen; and, once accurate registration of the substrate media is achieved, the media must not be allowed to move out of registration as it is delivered to the print zone.

Because contemporary systems, of that time, transferred media by means of laterally spaced-apart drive rollers located in registration nip assemblies, U.S. Pat. No. 9,132,673 inventors noted that rollers of that era do not hold the media flat, and therefore can subject the media to misalignment. These inventors noted that media acquisition by the belt can be by electrostatic tacking, and they further noted that such electrostatic tacking has the advantages of holding the media flat, and eliminating registration shift. These inventors further noted that a vacuum on the platen may be used to further ensure flatness. A problem these inventors noted arises in that friction-induced tribo-electric charges between a belt and platen (and elsewhere) generate undesirable electrostatic fields in the ink ejection area which may adversely affect print quality. These inventors noted that use of a conductive belt will circumvent this but can make it difficult to achieve desirable low, controlled fields between the media and a print head over a wide range of media properties. Based on these problems, the U.S. Pat. No. 9,132,673 inventors disclosed and described a system, where a belt is held flat and caused to slide across an electrically conductive platen, which could result in build-up of electrostatic charges on the belt, were it not for the fact the belt is semi-conductive, specifically to prevent charge build-up.

Thus, their belt was provided with an effective surface resistivity between a lower limit to preclude a build-up of electrostatic charges, and an upper limit to enable electrostatic tacking of media to the belt, where effective surface resistivity limits vary depending on belt velocity, thickness, material, belt and media dielectric constant, and slot width. U.S. Pat. No. 9,132,673 also discloses a pair of charged nip rollers that tack the media substrate to the belt.

However, U.S. Pat. No. 9,132,673 did not solve a problem associated with the contamination of printhead faceplates, resulting from the "misting" of the printhead faceplates.

While these various approaches to solving the many problems that are associated with conventional ink-jet printing systems have resulted in marked improvements being made to assorted ink-jet printing systems throughout the years, high-speed printing operations along with current demand for the highest levels of print quality are unrelenting. Thus, the message is really quite simple. To retain customer loyalty, superior image quality must be maintained.

OBJECTS AND SUMMARY

The various objects of our invention were not only to design an ink-jet printing system which solves or avoids most if not all of the problems experienced in the prior art, many of those problems having been briefly discussed above, but also to design an ink-jet printing system which solves or avoids most problems arising from present advances in ink-jet printing technology. Throughout the following drawings, like reference numerals shall refer to like parts.

Our invention may be summarized as follows. In a system for transporting a plurality of sheets of media seriatim along a path from a media-uptake zone and thereafter through a print zone, our invention may be thought of as a mechanism or apparatus comprising a number of components. One component of our system is an electrically-grounded base. Another component is a support member electrically-connected to the base. Yet another component is a belt formed into a closed loop having two continuous surfaces, one of which is the inner surface and the other of which is an electrically-conductive outer or exterior surface.

Still another component of our system is an electric circuit comprising the base and the support member, both of which are electrically-grounded. The electric circuit further includes means for electrically connecting the electrically-conductive surface of the belt to the support member, which results in the grounding of the electrically-conductive belt surface.

In operation, the electric circuit described above enables electrostatic charge on the exterior surface of the belt (which would otherwise build up) to dissipate, so that when ink is jetted onto media passing through the print zone, inkjet faceplates remain free of ink droplets.

The media-transport apparatus includes a plurality of rollers, each of the rollers being in rolling engagement with the belt. The apparatus also includes a motor-driven roller. The motor-driver roller causes the belt to transport sheets of media on the exterior surface of the belt along a path seriatim from the media-uptake zone and thereafter through a print zone.

The entire length of belt is provided with a plurality of apertures, substantially along the width, preferably clustered in preselected patterns, for allowing a vacuum source, located beneath the belt, to retain sheets of media flatly atop the conductive surface of the belt.

The belt includes a base layer (also referred to as a support layer), made from either a thermoset or a thermoplastic polymer material underneath the electrically-conductive layer. The conductive layer includes a polymeric ingredient, and optionally includes a conductive ingredient or filler, an optional plasticizer, and an optional leveling agent. The conductive layer has a surface resistivity of from about $10^1$ to $10^6$ ohms per square—when on the support layer.

DETAILED DESCRIPTION

While the present invention shall now be described in connection with the various illustrated exemplary embodiments, which includes the present drawings, it is to be understood that it is not our intention to limit our invention to these illustrative embodiments. On the contrary, it is our intent that our invention cover all alternatives, modifications and equivalents, to which we are entitled, which are included within the spirit and scope of the appended claims.

Our present invention is directed to a novel media-transport system that has been especially designed to be used in a conventional high-speed inkjet-based production printing system. To better understand the environment for which our invention is intended, please refer to U.S. Pat. No. 9,132,673, incorporated herein by reference in its entirety, for the details regarding an exemplary production printing system that could make use of the disclosed technologies.

Figure 1:
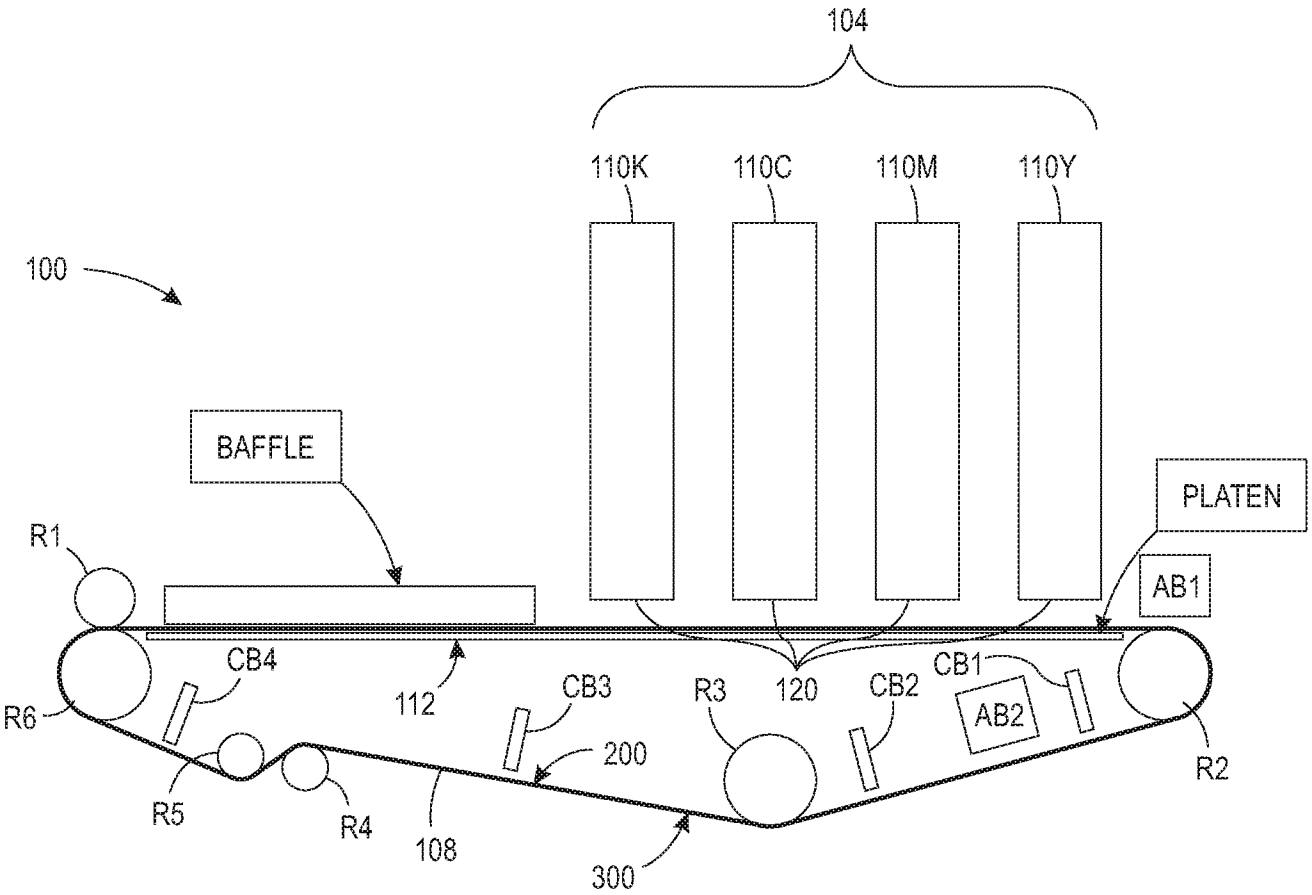
FIG. 1 is a drawing, in the form of a simplified schematic, presenting a side elevational view of a portion of the system for transporting media, depicting a media-transport belt and its associated inkjet printing zone, designed for use with the disclosed technologies.

FIG. 1, a schematic drawing, depicts a high-speed system 100 for transporting media, such as paper, to a conventional print zone 104 (defined hereinbelow). The illustrated media-transport system 100 includes a novel smooth-surfaced belt 108, seamed or seamless, preferably mounted on rollers R2, R3, R5 and R6, at least one of which rollers R2, R3, R5 and R6 is operably connected to a motor (not shown) to drive the belt 108, for causing media that is on the belt 108 to be "transported," i.e., moved from left to right, relative to FIG. 1, through the print zone 104. The print zone 104 provides the ink jet print heads, represented by exemplary black ink print head 110K, exemplary cyan ink print head 110C, exemplary magenta ink print head 110M, and exemplary yellow ink print head 110Y. Each of the above-mentioned ink-jet print heads 110K, 110C, 110M and 110Y depicted in FIG. 1, includes its own face plate 120, closely-spaced to the belt 108, for precisely jetting ink onto media that is carried by belt 108 through the print zone 104: defined by at least one of print heads 110K, 110C, 110M and 110Y.

The term "media" as used throughout this disclosure is understood by one of ordinary skill in the present technology as referring, e.g., to a pre-cut and generally flat sheet of paper, film, parchment, transparency, plastic, fabric, photo-finished substrate, paper-based flat substrate, or other substrate, whether coated or non-coated, on which information including text, images, or both can be reproduced. Generally, at least a portion of the information noted may be in digital form, since pre-imaged substrates may include images that are not digital in origin. The information can be reproduced as repeating patterns on media in the form of a web.

Belt 108, whether seamed or seamless, is formed as an endless loop. The endless loop is dimensioned to fit snuggly on at least the rollers R2, R3, R5 and R6. Each of rollers R1-R6 is electrically grounded. Each of rollers R2, R3, R5 and R6 has a rubber coating to electrically isolate each of rollers R2, R3, R5 and R6 from an inner surface 102 of media-transport belt 108. While belt 108 is shown as having a seam (FIG. 2), if a seamless belt is desired, a process for forming a seamless belt is disclosed in U.S. Pat. No. 6,106,762—hereby incorporated by reference.

During operation of media-transport system 100, it may be necessary to make an adjustment to maintain a desired tension for the media-transport belt 108 while on the rollers R2, R3, R5 and R6, without introducing unnecessary drag to the media transport system 100, by increasing, e.g., spacing between rollers R2 and R6, as it is very important to maintain the desired registration speed of media-transport belt 108. Also, for various reasons known to one of ordinary skill in the art, the media-transport belt 108 must be constructed of materials that resist deterioration by—and are otherwise impervious to—aqueous ink, isopropanol, or both.

Figure 2:
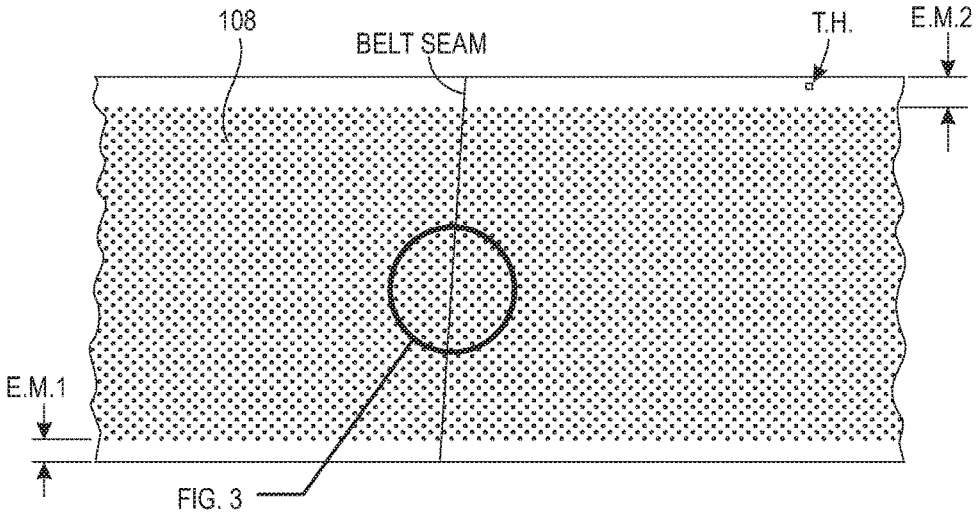
FIG. 2 is a fragmented plan view of an exemplary embodiment of the present media-transport belt that appears on edge in FIG. 1, on an enlarged scale relative to FIG. 1.

In addition, the media-transport belt 108 must be totally opaque, so as to not interfere with a belt speed sensing device (not shown), typically located beneath a timing hole ("T.H."), able to sense through an edge margin of belt 108. (FIG. 2.) Also, media-transport belt 108 must be of a construction that substantially eliminates generation of a static field since, during operation of system 100, sheets of media travel at speeds of 1 meter per second, from left to right relative to FIG. 1, as a result of the device noted above sensing the location of timing hole T.H. passing by, resulting in control of the linear speed of media-transport belt 108.

During operation of media-transport system 100, the movement of belt 108 from left to right relative to FIG. 1, enables media (not shown) placed on the belt 108 to move toward the print zone 104 where tiny droplets of ink are sprayed onto the media in a controlled manner, for the purpose of printing a desired image or text onto media passing by. In conventional direct-to-media ink-jet marking engines, an ink jet print head is mounted such that its face (where ink nozzles are located) is spaced, typically 1 mm or less, from the media surface. Since media such as paper may possess a curl property that lifts at least a portion of the media more than 1 mm above the surface of transport belt 108, the curl property of the media poses a problem whenever sheets of paper contact a print head when passing through print zone 104.

Shown in FIG. 1 is a vacuum plenum with a platen 112 as its upper surface. Since vacuum plenums are well known, please refer to U.S. Pat. No. 8,408,539 hereby incorporated by reference in its entirety for details. The platen 112 in FIG. 1 of the present specification is electrically conductive, and presents a flat surface against which the media-transport belt 108 is held. Belt 108 is caused to slide across the flat surface of platen 112 by a motor (not shown) powering at least one of the rollers R2, R3, R5 and R6, to cause sheets of media (not shown) carried by the media-transport belt 108 to move from left-to-right, relative to FIG. 1, through the print zone 104. In operation, the platen 112 depicted presents a fixed surface, and transport belt 108 is caused to slide thereacross. The surface of platen 112, across which media-transport belt 108 slides, is electrically-conductive; and electrostatic charge will build up when this portion of the media-transport system 100 is operational. Also, the vacuum plenum that has platen 112 as its upper surface includes a plurality of conventional slots (not shown) over which the media-transport belt 108 passes; and it is the presence of these slots which enable the vacuum plenum portion of platen 112 to subject media-transport belt 108 to vacuum. (See U.S. Pat. No. 8,408,539.)

Figure 3:
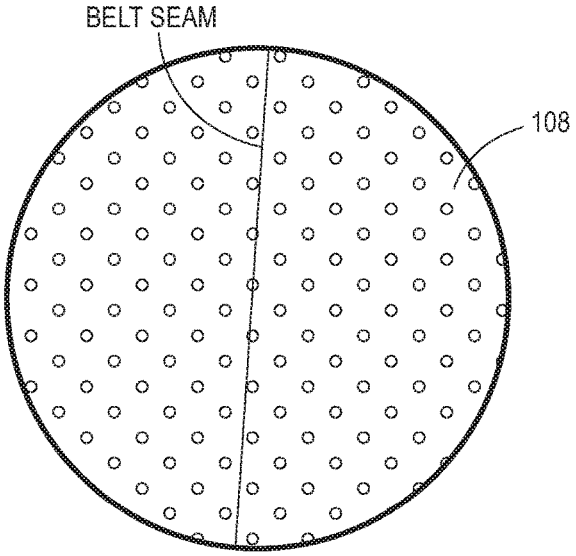
FIG. 3 presents certain details of an embodiment of the media-transport belt depicted in FIG. 2, with the details now being shown on an enlarged scale relative to FIG. 2.

To solve the curl problem briefly mentioned above, we designed the illustrated embodiment of our novel media-transport belt 108 to have a plurality of apertures extending substantially across its width, as shown in FIG. 2, leaving only edge margins E.M.1 and E.M.2 to be free of apertures as well as any surface coating, for enabling the vacuum plenum located beneath belt 108 to cause media to be drawn to belt 108. We found a square pattern for the apertures to be suitable for our purposes, where an individual aperture is generally circular, and has a diameter of about 2 mm, where the "pattern" (mentioned above) forms a square, and has a hole spacing, on a side of about 6.35 mm (millimeters) between centers, as shown in FIG. 3.

To firmly attach media of a particular dimension, particular stiffness property, or gauge (i.e., particular weight per unit area) to media-transport belt 108, one of ordinary skill in this particular technology will know how to alter aperture size and spacing throughout the media-transport belt 108, when using a vacuum hold down device, such as is disclosed in U.S. Pat. No. 8,408,539, incorporated by reference in its entirety. Media-transport belt 108, made to be entirely opaque, includes at least one timing hole through an edge margin. (See FIG. 2.)

We thus concluded that using vacuum to "fix" media onto an operational upper surface of a belt ought to solve the "curl" problem. Yet, in our efforts, we discovered we had found problems not yet found in U.S. Pat. No. 9,132,673 which is directed to a semi-conductive media transport belt for an ink jet printing system. In U.S. Pat. No. 9,132,673—the belt, held flat, is moved across a conductive platen, which results in buildup of electrostatic charges on the belt. The '673 belt, made to be semi-conductive to prevent charge buildup, was especially designed to have an effective surface resistivity between a lower limit to preclude a buildup of electrostatic charges, and an upper limit, to cause media to be electrostatically-tacked to the '673 belt. During operation of our system, problems not yet discovered in U.S. Pat. No. 9,132,673 were noted. For example, during operation of our system, we discovered that ink jet droplets would routinely become electrically charged by the ink jet print heads forming them, which we confirmed in our efforts to solve a particular problem we faced: i.e., misdirected ink jet droplets.

It was only after extensive investigation of a print-zone portion of our prototype media-transport system that we discovered that build-up of static charge on the belt poses a significant problem. Our solution to that problem resulted in a belt of unique construction. Our belt is partially-conductive and has special electrical properties on the side of the belt that transports media, e.g., paper. Thus, our belt, of special construction, illustrates one component of a media-transport system that operationally co-operates with certain other components of the media-transport system, for enabling electric charge continuously to dissipate from the belt.

Figure 4:
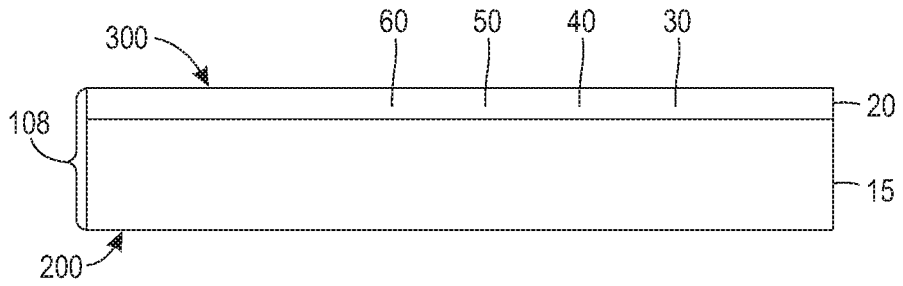
FIG. 4 is a side elevational view, showing an exemplary two-layer embodiment of belt 108, on an enlarged scale relative to FIG. 1, mindful that belt 108 may be multi-layered.

Our novel media-transport belt 108, illustrated in FIG. 4, is seen to comprise a supporting substrate layer 15 and a partially-conductive layer 20. Please note that the term "conductive" for any particular component or material throughout this disclosure shall be understood to refer to an electrically-conductive property of a component or material unless a thermally-conductive property is expressly disclosed. In order to provide a detailed disclosure, conductive layer 20, which we refer to as partially electrically conductive, as it possesses a resistivity of from about $10^1$ to about $10^6$ ohms per square, shall be described in detail below.

The supporting substrate layer 15 is polymeric and preferably made from either a "thermoplastic" polymer such as polyester or a "thermoset" polymer such as polyimide. One of ordinary skill in the art knows that a "thermoplastic" is a high polymer that softens when exposed to heat and returns to its original condition when cooled to room temperature (about 25° C.). The term "thermoplastic" is usually applied to such synthetics as nylons, polyvinyl chloride, fluorocarbons, polypropylene, cellulosic and acrylic resins, polystyrene, polyurethane prepolymer, and linear polyethylene. (See p. 1016 of Condensed Chemical Dictionary, $10^{th}$ edition, published 1981, by Van Nostrand Reinhold Co.) One of ordinary skill in the art also knows that a "thermoset" is a high polymer that solidifies or "sets" irreversibly when heated. This property is usually associated with a cross-linking reaction of associated molecular constituents induced by heat or radiation. Examples of "thermosets" include phenolics, alkyds, amino resins, epoxides and silicones. Also, linear polyethylene can, e.g., be cross-linked to become a thermosetting material either by radiation or by chemical reaction. (See p. 1016 of Condensed Chemical Dictionary, 10th edition, published 1981, by Van Nostrand Reinhold Co.)

As noted, layer 20 has a surface resistivity ranging from about $10^1$ to about $10^6$ ohms per square (ohms/square). Layer 20 provides a polymeric coating, preferably comprising a polyester, and a conductive component, e.g., carbon black. We have discovered that layer 20 must possess partial conductivity and have a surface resistivity as disclosed above to eliminate printhead faceplate contamination, currently referred to as the "misting" problem that we observed, in high-speed video recordings, as being caused by satellite inkjet droplets (described, e.g., in U.S. Pat. No. 4,734,705) returning to printheads, to cause fouling of the inkjet faceplates.

Theoretical Considerations Causing Misting

As an inkjet head releases ink through a jet, the released inkjet drops have occasion to neck down and in some instances separate. As a drop is necking down there is a charge migration within the drop driven by static electric fields within a gap located between the belt (that is transporting media) and the inkjet head. As the drops fall due to gravity some of the drops experience a separation of very small satellite droplets which are charged with the same sign as the paper (i.e., the media) on the belt. Same-sign repulsion results in tiny satellite ink droplets being re-deposited, against gravity, on the inkjet printhead faceplates, eventually contaminating faceplates, blocking the inkjets and causing unacceptable print-quality defects.

We found, although our design contained two active antistatic bars, four passive carbon brushes, and electrically-grounded rollers, that we were not able to reduce the voltage on the belt to below 100 volts. We therefore originally designed our belt to be more conductive. We ultimately discovered that coatings having an electrical resistivity ranging between about $10^1$ to about $10^6$ ohms per square, or between about $10^1$ to about $10^4$ ohms per square, or between about $10^4$ to about $10^6$ ohms per square, could reduce, at times quite significantly (depending upon the temperature and percent relative humidity), the electric field located between the belt (transporting the media) and the inkjet printheads to less than about 25 volts when the media-transport system 100 was operational (see FIG. 5). We thus found the range from minus 25 volts to plus 25 volts substantially eliminated re-depositing of the mist (caused by the satellite droplets) on the inkjet faceplates, solving the faceplate contamination problem.

FIG. 1

Briefly, as ink drops neck down, a charge migration occurs within a drop due to an electric field, causing the misting problem noted. To avoid a misting problem, low level electric fields are maintained between transport belt 108 and faceplates 120 of each of the ink jet print heads 110K, 110C, 110M and 110Y. (FIG. 1.) Nominally, electric charge on belt 108 ranges from about positive 100 volts to about positive 300 volts in print zone 104. However, we have found (please refer to FIG. 5), as a result of high-speed video images we recorded, that reducing and maintaining these fields within a range of from about minus (or negative) 25 volts to about plus (or positive) 25 volts, when voltage is measured on a media-carrying surface 103 of transport belt 108, that a substantial reduction and at times virtual elimination of the face plate "misting" problem (noted above) is experienced. For, as mentioned above, the "misting" problem caused by satellite droplets must be avoided, if one is to maintain superior print quality.

FIG. 5

Figure 5:
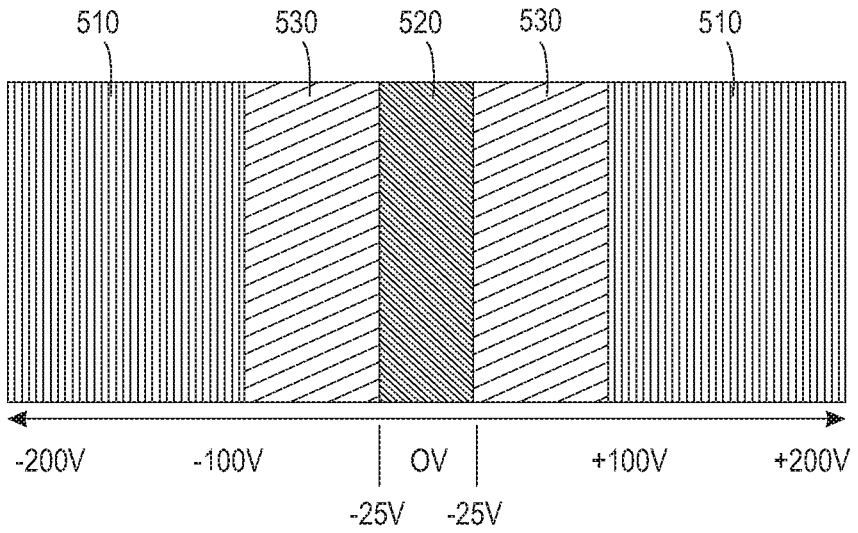
FIG. 5—a "concept" drawing that subjectively represents amount or degree of nozzle plate "misting," to an observer, as a result of field voltage—is based on our observations.

FIG. 5 resulted from our observations, at various temperature and humidity conditions, based on the video recordings that we made when we used commercially-available high-speed recording equipment. Briefly, FIG. 5 is a representation of the effects of certain ranges of electric field strength, measured on the belt, where the reference numeral 510 represents a zone where electric field voltages that ranged between about 100 to 200 volts (positive or negative) were found to result in heavy nozzle plate "misting." Further in this regard, the reference numeral 530 represents an intermediate zone, where electric field voltages that ranged between 25 to 100 volts (positive or negative) were found to result in still unacceptable misting. Reference numeral 520, where field voltages were found to range from about minus (or negative) 25 volts to about plus (or positive) 25 volts when field voltage is measured on the surface of belt 108 were found to substantially reduce, or eliminate, face plate contamination.

FIG. 4

The embodiment of layer 20, as depicted in FIG. 4, is seen to comprise select polymeric ingredients 30, optional conductive components or fillers 40, optional plasticizers 50, and optional leveling agents 60. The partially conductive layer or coating 20 has a thickness that ranges from about 5 to about 30 microns, or that ranges from about 10 to about 15 microns. The ingredients of the conductive layer 20, for belt 108, shall now be described in further detail.

Examples of Polyesters

Examples of polyesters included in the conductive coating 20 include aromatic polyester copolymers such as VITEL® 1200B (Tg=69° C.; Mw=45,000, a co-polyester made from ethylene glycol, diethylene glycol, terephthalic acid, and isophthalic acid), 3300B (Tg=18° C.; Mw=63,000), 3350B (Tg=18° C.; Mw=63,000), 3200B (Tg=17° C.; Mw=63,500), 3550B (Tg=minus 11° C.; Mw=75,000), 3650B (Tg=minus 10° C.; Mw=73,000), 2200B (Tg=69° C.; Mw=42,000, a co-polyester prepared from ethylene glycol, diethylene glycol, neopentyl glycol, terephthalic acid, and isophthalic acid), 2300B (Tg=69° C.; Mw=45,000), all commercially-available from Bostik, an internationally-known adhesives company, headquartered in Milwaukee, Wis. (The abbreviation Mw stands for weight-average molecular weight, and the abbreviation Mn stands for number-average molecular weight.) It is contemplated that surface coating 20 may include a plasticizer ingredient 50 as well as a leveling agent ingredient 60, both being optional.

Examples of Conductive Components or Fillers

We have found that useful examples of commercially-available conductive components or fillers 40 suitable for inclusion in the partially-conductive coating 20 disclosed herein include carbon black as well as most other forms of carbon, such as, for example, graphite, carbon nanotubes, fullerene, and graphene; also useful are metal oxides or mixed metal oxides; and such conductive polymers as polyaniline, polythiophene, and polypyrrole.

Examples of Plasticizer Ingredients

Examples of commercially-available plasticizer ingredients that are suitable for inclusion in the partially-conductive surface coating 20 disclosed herein include diethyl phthalate (DEP), dioctyl phthalate, diallyl phthalate, polypropylene glycol dibenzoate, di-2-ethyl hexyl phthalate, diisononyl phthalate, di-2-propyl heptyl phthalate, diisodecyl phthalate, and di-2-ethyl hexyl terephthalate, as well as several other known suitable plasticizer ingredients.

Examples of Leveling Agents

Examples of commercially-available leveling agent ingredients suitable for inclusion in the partially-conductive surface coating 20 disclosed herein include a polyester modified polydimethylsiloxane having the trade name BYK®310 (about 25 weight percent in xylene) and BYK® 370 (about 25 weight percent, in xylene/alkylbenzenes/cyclohexanone/monophenylglycol, weight percentages 75/11/7/7); a polyether modified polydimethylsiloxane having the trade name BYK®333, BYK®330 (about 51 weight percent in methoxypropylacetate) and BYK® 344 (about 52.3 wt.-% in xylene/isobutanol, at the wt.-% 80/20), BYK®-SILCLEAN 3710 and 3720 (about 25 weight percent in methoxypropanol); a polyacrylate modified polydimethylsiloxane having the trade name BYK®-SILCLEAN 3700 (about 25 wt.-% in methoxy-propylacetate); or a polyester polyether modified polydimethylsiloxane having the trade name BYK® 375 (about 25 wt.-% in di-propylene glycol monomethyl ether), all available from BYK Chemical, a global supplier of instruments and additive ingredients, located in Wesel, Germany.

Examples of Polymers Suitable as Supporting Layer 15

Examples of commercially-available polymeric substances suitable as supporting substrate layer 15 include such polyesters as polyethylene terephthalate (PET), polybutylene terephthalate (PBT), and polyethylene naphthalate (PEN); polyamides; polyetherimides; polyamideimides; polyimides; polyphenyl sulfides; polyether ether ketones; polysulfones; polycarbonates; polyvinyl halides; polyolefins; and mixtures and combinations thereof.

An Illustrative Method of Making Media Transport Belt 108

An illustrative method of making our novel media transport belt 108 comprises: selecting a substrate suitable as a substrate layer 15, and forming the substrate thus selected into an elongated strip of desired width and length, in order to serve as a belt, wherein the elongated strip has a desired thickness, so that the strip may serve as an elongated substrate layer, of suitable length, wherein the elongated strip has opposite end portions; formulating from preselected ingredients noted above a partially-conductive formulation, preferably in the form of a dispersion, which dispersion may be used to coat an upper surface of the elongated substrate layer, from one end portion to the opposite end portion; applying the dispersion, preferably via extrusion, onto the entire upper surface of the elongated substrate layer, from one end portion to the opposite end portion; drying or curing the dispersion, for forming a partially-conductive coating on the upper surface along the entire length of the substrate layer; fashioning the coated substrate layer into an endless belt, preferably by welding, or otherwise joining the substrate layer end portions together, preferably by ultrasonic welding, to produce an endless media transport belt, so that the media transport belt has an inner surface and a conductive or partially-conductive outer surface provided by the surface coating; and forming, preferably by perforating in a predefined pattern, a plurality of apertures through the belt.

In addition to our method, disclosed and described above, for making our novel endless flexible seamed belt, U.S. Pat. No. 5,997,974, hereby incorporated by reference in its entirety, discloses another method, known to one of ordinary skill in the art, for making similar endless flexible seamed belts, each of which uses a different so-called "invisible" seam, for enabling a belt to maintain its mechanical (i.e., structural) integrity and its electrical continuity.

The following EXAMPLE lists ingredients used to produce a dispersion for coating supporting substrate 15.

Example

| INGREDIENTS | | WEIGHT, |
|---|---|---|
| Trade Name | Description | pounds |
| — | Methylene Chloride (Solvent) | 112.98 |
| EMPEROR ® 1200 | Carbon Black (conductive ingredient) | 7.3 |
| VITEL ® 1200B | Polyester Co-polymer | 7.3 |
| — | Diethyl Phthalate (Plasticizer) | 0.74 |
| BYK ® 333 | Leveling Agent | 0.074 |

Note:
In this example, the total weight percentage of solids is 12.005%.

Process

Two 20 L (twenty liter) carboys were filled with 28 pounds of smooth surface 440C stainless steel shot, EMPEROR®1200 carbon black, BYK®333 leveling agent, diethyl phthalate, and methylene chloride solvent. Each carboy was then disposed between a spaced-apart pair of two rollers, with one roller being driven by a motor, to rotate the carboy, thereby causing the stainless steel shot to roll and agitate, for the purpose of dispersing the carbon. This milling process was carried out for 8 hours. After milling, the contents of both carboys were added to a stirred vessel, and then diluted with 10 wt.-% VITEL®200B in methylene chloride solution.

The final coating composition included: EMPEROR® 1200 carbon black/VITEL® 1200B polyester co-polymer/BYK® 333 leveling agent/diethyl phthalate plasticizer (at 47.4/47.4/0.5/4.7 weight based values for these solids), in methylene chloride. As noted above, this was: 12.005 total wt.-% solids.

Suitable Solvents for Making a Belt

Requirements of a solvent used to make the sort of belt we disclose herein are as follows: The solvent must be able to dissolve the binder, i.e., the polyester polymer used; and the solvent must have a boiling point sufficiently low enough to facilitate drying of the solvent-borne ingredients, for purposes of enabling the solvent to evaporate. Preferred solvents are polar, since a polyester linkage is polar. Thus, suitable classes of solvents include chlorinate organics (i.e., methylene chloride); ethers (straight chain or cyclical such as tetrahydrofuran); other esters such as ethyl acetate; and aromatics such as monochlorobenzene, toluene, and trifluorotoluene, as well as certain diacids including terephthalic acid and isophthalic acid.

Coating the Dispersion onto a Polymeric Substrate Via Extrusion:

The following shall demonstrate an exemplary method of using our dispersion to form a coating on an elongated strip of polymeric substrate via extrusion. Starting with a commercial 2,000 foot long roll of 18 inch wide, 4-mil thick PET (polyethylene terephthalate), an elongated strip of 4-mil thick PET sheet was obtained. (One mil=0.001 inches.) The dispersion was applied to a flat surface of the elongated strip of 4-mil thick PET (polyethylene terephthalate) sheet via extrusion, and then dried at 266° F. at very low humidity for a time period spanning from about 3 to about 4 minutes, to form a smooth coating on the flat surface of the elongated strip of 4-mil thick PET. The coating thus formed (on the PET) was found to be about 10 microns thick, and to have a surface resistivity of about $1.0\times10^4$ ohms per square.

Welding the Coated Polymeric Substrate Sheet into a Seamed Belt Via an Ultrasonic Process:

The following detailed description shall demonstrate an exemplary method we employed to join together the opposite ends of the elongated strip of PET coated as described above, to form a looped endless belt.

The above-described elongated strip of belt material (originally 18 inches=457.2 mm wide), with the above-described partially-conductive polymeric material coated on a smooth surface thereof, was cut longitudinally along opposite edge margins of the belt material, to produce a 455 mm-wide elongated strip coated with the formulation described above, and then slit longitudinally along opposite edge margins, to produce a 440 mm-wide coated elongated strip of belt material, after removal of the coating from edge margins of the elongated strip of belt material, to produce uncoated edge margins, as shown in FIG. 2.

The elongated strip of belt material was then formed into a loop by bringing the opposite end portions of the elongated strip of belt material together in an overlap fashion.

Thereafter, a commercially-available edge-offset reduction system, consisting of a high-resolution camera, the output of which provides feedback control to a motor that adjusts the edge margins of the endless looped belt such that they do not vary from each other (relative to a longitudinal centerline) by more than 300 μm (micrometers), was used to minimize any endless loop irregularities (such as "conicity", a term used by one of ordinary skill in the art to describe any conic-shaped irregularity) throughout the entire circumference of the belt.

At this point, the overlapped end portions of the belt are permanently joined via ultrasonic welding, to produce a seamed belt, also characterized as a closed circular loop, measuring 655 mm (millimeters) in diameter by 440 mm wide. For our purposes, we used commercially-available Branson ultrasonic welding equipment, to continuously join the opposite end portions of our novel media-transport belt, to produce our overlapped seam.

We selected the following process parameters for purposes of removing any coating present in the overlap area. Specifically, to facilitate joining together the two ends of the polymeric substrate, coating material trapped between end layers of substrate material was heated to a liquid state during the welding process, and forced out of the overlap area, resulting in a superior weld. The seam-break strength was found to be greater than 50 pounds per inch.

Any material forced out of the ends of the overlap was then removed from the belt. Then, a timing hole (see FIG. 2), was formed entirely through an edge margin of the belt.

Our process (above) that included the steps of cutting, slitting, overlapping, and finally welding, resulted in the edge margins of the looped belt not varying by more than about 300 μm (micrometer) throughout the entire circumference of the looped belt. The dimensional precision described herein was found to enable the active steering system of a conventional high-speed inkjet printer—comprising a combination of position sensors designed to provide feedback to a motorized cam that controls a steering roller in a modular system of the belt—to provide the high-speed inkjet printer with highly accurate motion-and-location registration.

Perforating the Seamed Belt in a Predefined Pattern:

The seamed belt that we made by the process described above was thereafter perforated (i.e., had apertures formed entirely through the belt) in a predetermined pattern by a third party, professionals for this purpose, resulting in the belt 108 shown in FIGS. 2 and 3.

In operation, we found we needed to add additional holes to our pattern, to further improve media edge hold down. At various positions in the cross-process direction, the distance between holes was reduced to half, to double the number of holes for that row in the process direction. Locations of double-density rows was determined using standard engineering practices, for various sizes of conventional media such as paper. The resulting increase in the belt aperture density, was found to enhance the vacuum effect of the media with respect to the edge margins of media on the belt, reducing lift or curl at the media edge margins, and resulting in further improvements in print quality and reduction of paper jams. One of ordinary skill in the art would therefore know how to modify belt aperture density to achieve desired hold down.

Proof of Concept

Machine testing in ambient conditions demonstrated a decrease in static field voltage on the coated surface of the belt, from an average of about 250 volts to less than about 15 volts. Preliminary testing of the media-transport belt that we made resulted in no noticeable misting of printhead faceplates after about 5,000 cycles through zone "J", representing the inkjet printhead environment, about 50° F. and 20% relative humidity. Also noted was an absence of droplets returning to foul inkjet faceplates, resulting in no faceplate contamination.

Continuously Dissipating Charge from Belt 108

As discussed in U.S. Pat. No. 9,132,673—during operation of, e.g., a high-speed production inkjet printing system, static electric charge will be found building-up on a media transport belt, the belt being a component of a subsystem of the production ink-jet printing system, and such build-up of static electric charge will result in problems that must be solved.

An inner surface 200 of the media transport belt 108, shown in FIG. 1, is in rolling contact with each of the rollers R2, R3, R5 and R6 described above. Shown straddling media transport belt 108 are two spaced-apart conventional active antistatic bars, AB1 and AB2, as well as a plurality of conventional commercially-available conventional passive carbon brushes, for example, passive carbon brushes CB1, CB2, CB3 and CB4, shown arranged in a known manner along the inner surface 200 of media transport belt 108, to dissipate any induced, static or other charge that might build up or be present on the inner surface 200 of media transfer belt 108.

Also, shown in FIG. 1 is a conventional baffle, which serves to isolate vacuum to the media intake area when media, e.g., paper is not present on belt 108. Roller R1 is located adjacent roller R6, to form a nip therebetween, to catch sheets of media in the nip and thereafter to use rollers R1 and R6 to co-operatively roll to force each sheet of media (not shown) onto an exterior surface 300 of media-transport belt 108, to enable media-transport belt 108 to transport media from the nip (provided by R1 and R6) to print zone 104. A region immediately to the left of rollers R1, R6 (FIG. 1) may thus be referred to as a media-uptake zone.

Roller R4, in rolling contact with exterior surface 300 of media transport belt 108, is a component of an electric circuit (that we shall now disclose and describe in detail). This electric circuit, which was discovered through our collaborative efforts, has been found to be quite useful, for enabling us to dissipate charge from the exterior surface 300 of the media transport belt 108, with substantial elimination of the "misting" and "satellite droplet" problems mentioned, resulting in clean ink jet face plates and no noticeable misdirected ink jet droplets.

As described above, the upper layer 20 of our novel media-transport belt 108 (FIG. 4) which is also the exterior surface 300 of media-transfer belt 108 (FIG. 1), provides a conductive surface. (In this disclosure, characterizing a surface as "partially-conductive" shall be interpreted as "electrically conductive" or simply "conductive," meaning capable of discharging electrons, so that any electric charge present is dissipated by the circuit to ground.)

Roller R4, shown in FIG. 1 as being in rolling contact with exterior surface 300 of our media transport belt 108, was designed to be electrically conductive and is thus provided with an electrically-conductive steel exterior surface. Please refer to FIG. 6 for more details regarding the electric circuit, that we found able to dissipate charge from exterior surface 300.

For media-transport belt 108, electric fields noted above (FIG. 5) are generated by motion of inner surface 200 of belt 108 across platen 112 (and other components) of our media-transport system 100 (FIG. 1). In general, to cause a thus-generated field to maintain a desired absolute value level (FIG. 5), we have found that the outer conductive surface 300 (FIG. 1) of belt 108 must possess a resistivity low enough to allow the static charge build-up to dissipate as fast as, or faster, than it is generated. For the linear speeds of belt operation we sought to maintain, we determined, to achieve the +/−25 volts (or less) field values we sought, that a resistivity value for the outer conductive surface 300 of belt 108 had to be less than about $10^5$ ohms per square. To modify the resistivity values of our experimental conductive coatings, we added more carbon to our experimental coating dispersions to change the resistivity values of our experimental coatings from $10^8$ ohms per square to $10^5$ ohms per square. One of ordinary skill in the art should know how to modify our EXAMPLE formulation to achieve desired values.

Maintenance of Belt 108

Figure 6:
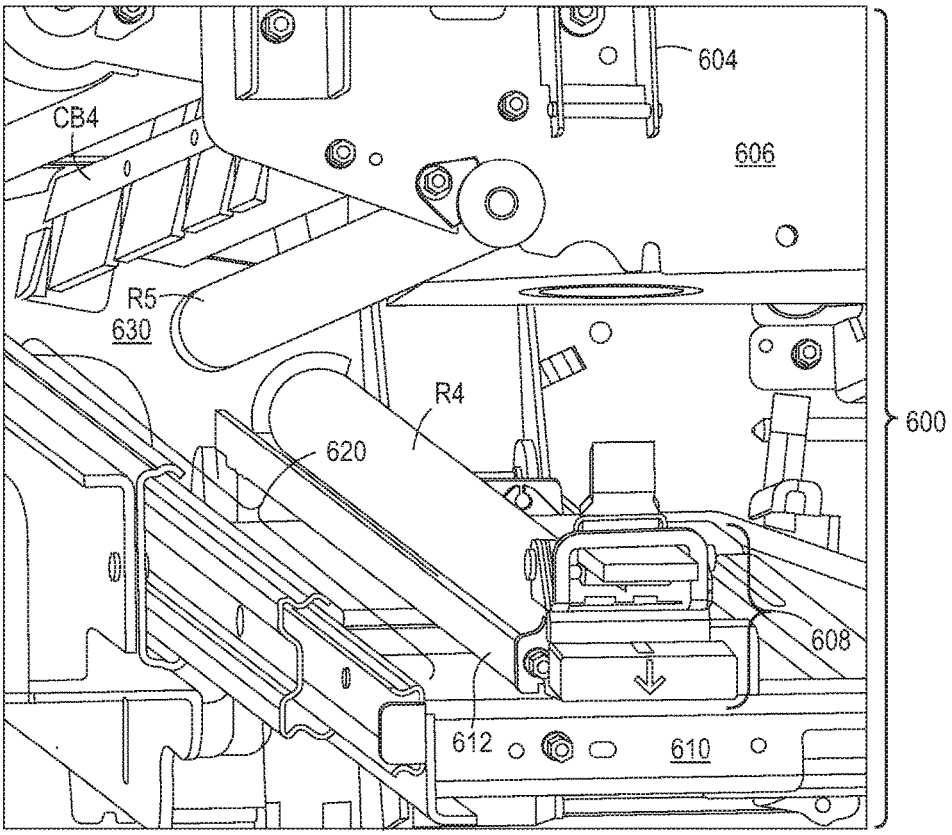
FIG. 6 is an isometric view of certain structural details of media-transport system 100, many of the structural details of FIG. 6 being depicted schematically in FIG. 1.

A portion 600 of many of the operational components of transport system 100 (which are not shown in FIG. 1) appear in FIG. 6, which depicts certain components of the media transport system 100, in isometric view, with the rollers R4 and R5 shown spread apart, with the media transport belt 108 having been removed from the media-transport system 100.

From our schematic drawing of the media-transport system 100 (FIG. 1), depicting a side elevational view of belt 108, one will note that rollers R4 and R5 are depicted in their normally-spaced relationship, when belt 108 is mounted on the rollers R2, R3, R5 and R6.

However, as media transport belt 108 will need to be replaced, from time to time, as one of ordinary skill is aware, a few of the several components of the media transport system 100, as depicted in FIG. 6, shall now briefly be discussed, to enable one of ordinary skill in the art to envision how belt maintenance or replacement can be achieved. Depicted in FIG. 6 is a latch cover 604 pivotally attached to a face plate 606 (which is grounded). Moreover, a latching mechanism 608 is shown fixed to a crossbar 610. Steel-face roller R4, rotatably mounted on a bearing (not shown), is longitudinally disposed in a mounting frame 612, also shown in FIG. 6. A bearing (not shown) for roller R4, electrically conductive and electrically connected to roller R4, is mounted in frame 612 to enable roller R4 to be in rolling contact with the conductive surface of belt 108, to cause the conductive surface of belt 108 to be in electrical contact with frame 612, fixed to the cross bar 610, and in electrical contact therewith. A similar bearing is disclosed and described in U.S. Pat. No. 6,594,460, hereby incorporated by reference in its entirety.

Cross bar 610 is fixed to a structural assembly 620, extensible-and-retractable relative to a back plate 630. The above-described electrical circuit enables cross bar 610 to be electrically connected to structural assembly 620, as well as to back plate 630. Also, since back plate 630 is grounded, the roller R4 is grounded as well, as a result of the above-described electrical circuit consisting of cross bar 610, structural assembly 620, and back plate 630. Thus, an electric circuit may be described by the following circuit elements: the exterior surface 300 of media transport belt 108 (where charge build-up occurs), which is electrically connected to steel face roller R4, which is electrically connected to the bearing described above, which is electrically connected to frame 612, which is electrically connected to cross bar 610, which is electrically connected to structural assembly 620, which is electrically connected to back plate 630, which is grounded. Thus, any electrical charge, electrostatic or otherwise, that builds up on exterior surface 300 of media transport belt 108 is dissipated by the electrical circuit described.

Figure 7:
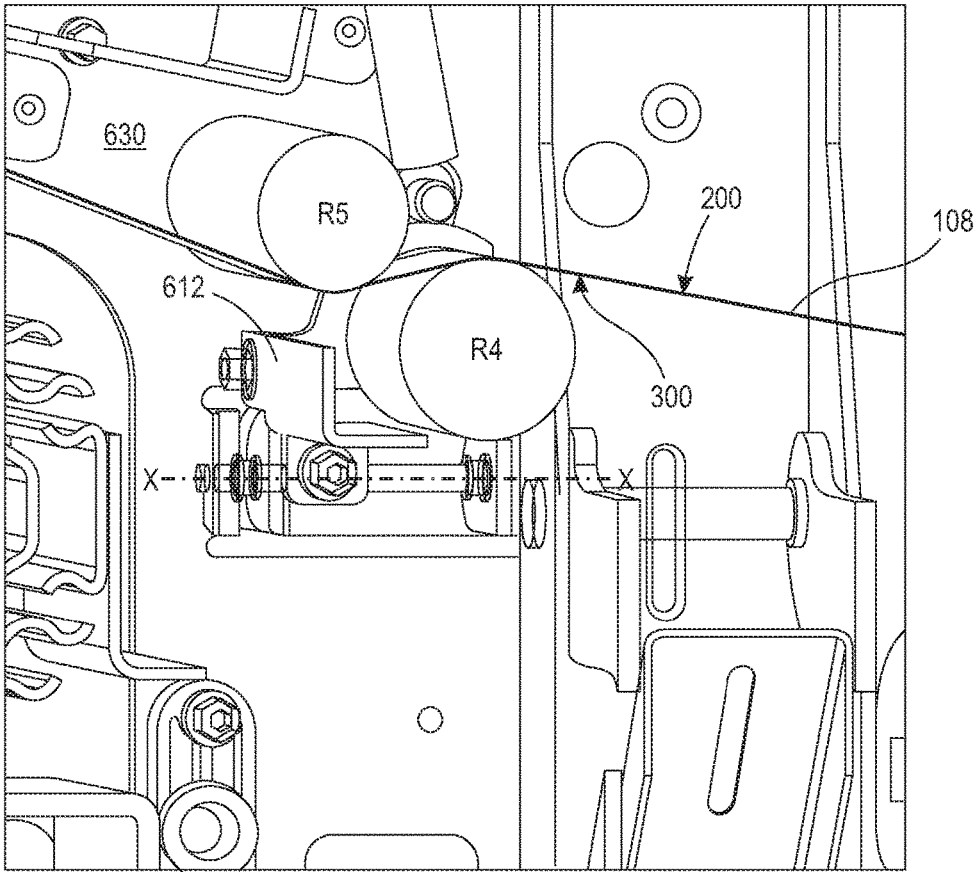
FIG. 7 is an isometric view of a portion of media-transport system 100, sectioned to expose details obscured or hidden in FIG. 6, and on an enlarged scale relative to FIG. 6.

The mounting frame 612 is pivotable, about axis X-X, to enable rollers R4 and R5, rotatably arranged about parallel longitudinal axes (suggested in FIG. 1 and shown more clearly in FIG. 7) to be spread apart, thereby forming an acute angle therebetween, after cross bar 610 is lowered relative to face plate 606, as shown in FIG. 6. The belt 108, not depicted in FIG. 6, was removed for maintenance. Accordingly, with the cross bar 610 thus lowered, as depicted in FIG. 6, either a replacement version or a repaired version of belt 108 may be mounted by one skilled in the art on rollers R2, R3, R5, R6, as shown schematically in FIG. 1, and cross bar 610 may be brought up toward face plate 606, to bring latching mechanism 608 up to latch cover 604 which is used to secure cross bar 610 to face plate 606, resulting in rollers R4 and R5 being brought into operable relation, with the media transport belt 108 between, as depicted schematically in FIG. 1, and in greater detail in a cutaway view provided by FIG. 7.

INDUSTRIAL APPLICABILITY

The media-transport system 100 illustrated by the accompanying figures and described in detail in this specification is but one of many designs for our Brenva ink jet program.

Alternatives, Changes and Modifications

What has been illustrated and described for use in high-speed inkjet printing machines is a novel apparatus for transporting a plurality of sheets of media seriatim along a path from a media-uptake zone and thereafter through a print-job zone. Yet, while our invention has been illustrated and described with reference to a variety of exemplary embodiments, our invention is not to be limited to these embodiments. On the contrary, alternatives, changes or modifications may be apparent to one skilled in the art upon reading the foregoing description. Accordingly, such alternatives, changes and modifications are to be considered as forming a part of our present invention insofar as they fall within the spirit and scope of the appended claims.

What is claimed is:

1. In a system for transporting a plurality of sheets of media seriatim along a process path extending from a media-uptake zone and thereafter through a print zone, an apparatus comprising:

an electrically-grounded base;

a support member electrically-connected to the base;

a belt formed into a closed loop having two continuous surfaces, one of which is an electrically-conductive exterior surface and the other of which is an inner surface; and an electric circuit comprising the base, the support member, the electrically-conductive surface of the belt and the support member, wherein the electric circuit results in electric-charge on the exterior surface of the belt being dissipated, whereby, when ink is jetted onto media passing through the print zone, ink jet face plates remain substantially free of ink droplets.

2. The apparatus of claim 1, further including:

means for causing the belt to transport media on the exterior surface of the belt along the path from the media-uptake zone and thereafter through the print zone.

3. The apparatus of claim 1, wherein the electrically-conductive surface of the belt is electrically connected to the support member by, a roller electrically connected to the electrically-conductive surface of the belt, and a bearing, wherein the bearing is electrically connected to the roller as well as to the support member.

4. The apparatus of claim 3, wherein the roller electrically connected to the electrically-conductive surface of the belt is a steel roller.

5. The apparatus of claim 1, wherein the belt is apertured for allowing a vacuum source to use vacuum to retain sheets of media flatly on the electrically-conductive surface of the belt.

6. The apparatus of claim 1, wherein the belt comprises a support layer and an electrically-conductive layer on the support layer.

7. The apparatus of claim 6, wherein the electrically-conductive layer has a surface resistivity of from about $10^1$ to about $10^6$ ohms per square when on the support layer.

8. The apparatus of claim 6, wherein the electrically-conductive layer comprises:

a polymeric ingredient;

an optional electrically-conductive ingredient;

an optional plasticizer ingredient; and an optional leveling agent ingredient.

9. The apparatus of claim 8, wherein the polymeric ingredient is a polyester.

10. The apparatus of claim 6, wherein the support layer is a thermoplastic or a thermoset.

11. The apparatus of claim 1, wherein field voltages range from about minus 25 volts to about plus 25 volts, when field voltage is measured on the conductive surface of the belt.

* * * * *